US009794662B1

(12) United States Patent
Lippitt

(10) Patent No.: US 9,794,662 B1
(45) Date of Patent: Oct. 17, 2017

(54) CONNECTION APPARATUS

(71) Applicant: Bose Corporation, Framingham, MA (US)

(72) Inventor: Benjamin C. Lippitt, Worcester, MA (US)

(73) Assignee: Bose Corporation, Framingham, MA (US)

( * ) Notice: Subject to any disclaimer, the term of this patent is extended or adjusted under 35 U.S.C. 154(b) by 16 days.

(21) Appl. No.: 15/083,391

(22) Filed: Mar. 29, 2016

(51) Int. Cl.
*H04R 1/02* (2006.01)

(52) U.S. Cl.
CPC ..... *H04R 1/026* (2013.01); *H04R 2201/025* (2013.01)

(58) Field of Classification Search
CPC ..... H04R 1/08; H04R 1/18; H04R 1/2815; H04R 2201/028; H04R 2201/029; H04R 2201/34; H04R 2205/021; H04R 2209/022; H04R 2499/11; H04R 2499/15; H04R 7/045; F16M 11/10; F16M 2200/024; F16M 2200/08
USPC ..... 381/387, 336, 340, 341; 248/558, 560, 248/178.1, 638, 27.1, 343, 342, 57
See application file for complete search history.

(56) References Cited

U.S. PATENT DOCUMENTS 5,163,167 A 11/1992 Heil
5,602,366 A 2/1997 Whelan et al.
6,536,554 B2 3/2003 Andrews et al.
6,640,924 B2 11/2003 Messner
6,652,046 B2 11/2003 Christner
7,036,781 B1 5/2006 Bothe
7,261,180 B1 8/2007 Faranda et al.
7,298,860 B2 11/2007 Engebretson et al.
7,328,769 B1 2/2008 Adamson
7,516,932 B2 4/2009 Engebretson et al.
7,634,100 B2 12/2009 Monitto et al.
7,693,296 B2 4/2010 Monitto et al.
7,967,103 B2 6/2011 Bothe
7,997,552 B2 8/2011 Engebretson et al.
8,130,996 B2 3/2012 Kling et al.
8,165,334 B2 4/2012 Iwayama
8,170,263 B2 5/2012 Engebretson et al.
(Continued)

FOREIGN PATENT DOCUMENTS

CN 2927574 Y 7/2007
CN 103037284 A 4/2013
(Continued)

*Primary Examiner* — Md S Elahee
*Assistant Examiner* — Julie X Dang

(57) ABSTRACT

In one aspect, an apparatus for connecting a first object to a second object includes a member with a plurality of teeth and an attachment element which includes a plurality of teeth which can engage with the teeth of the member. One of the member and the attachment element are securable to one of the first and second objects. The other of the member and the attachment element are securable to the other of the first and second objects. A securing device prevents the member's teeth from disengaging with the attachment element's teeth such that the attachment element is secured to the member at a certain location along the member. As such, the attachment element can be secured to the member at a plurality of different locations along the member so that the first object can be connected to the second object in a plurality of different positions.

18 Claims, 5 Drawing Sheets

(56) References Cited

U.S. PATENT DOCUMENTS

| | | | | |
|---|---|---|---|---|
| D692,863 | S | 11/2013 | Givre et al. | |
| D692,864 | S | 11/2013 | Givre et al. | |
| D692,865 | S | 11/2013 | Givre et al. | |
| 8,590,666 | B2 | 11/2013 | Adamson et al. | |
| 8,600,097 | B2 | 12/2013 | McGhee et al. | |
| D698,336 | S | 1/2014 | Givre et al. | |
| 8,807,270 | B2 | 8/2014 | Givre | |
| 8,842,867 | B2 | 9/2014 | Bothe | |
| 2006/0256976 | A1 | 11/2006 | House | |
| 2008/0170729 | A1 | 7/2008 | Lissaman et al. | |
| 2012/0189420 | A1 | 7/2012 | Kemper et al. | |
| 2013/0208936 | A1 | 8/2013 | McGhee et al. | |
| 2014/0205132 | A1 | 7/2014 | Spillmann et al. | |
| 2014/0301580 | A1 | 10/2014 | Andrews et al. | |
| 2014/0307907 | A1* | 10/2014 | Takeuchi ..... | H04R 1/02 381/334 |
| 2014/0353074 | A1 | 12/2014 | Bridge et al. | |

FOREIGN PATENT DOCUMENTS

| | | | |
|---|---|---|---|
| DE | 102012110648 | A1 | 5/2014 |
| GB | 2512690 | A | 10/2014 |

* cited by examiner

CONNECTION APPARATUS

BACKGROUND

This disclosure relates to a connection apparatus for securing two objects together.

U.S. Pat. No. 7,967,103 discloses an attachment apparatus for forming an arrangement including a plurality of loudspeaker boxes hanging one above the other. The arrangement has first and second loudspeaker boxes, and a latching hook having a first portion which is pivotably fastened to the first loudspeaker box and having a second portion which is designed as a hook element. A holding element is mounted on the second loudspeaker box and interacts with the hook element of the latching hook of the first loudspeaker box to attach the second loudspeaker box to the first loudspeaker box. A profiled part is provided with a hole grid and mounted on the second loudspeaker box. The holding element is a strain bolt which can be inserted into holes in the hole grid. The profiled part is in the form of a U-profile with hole grids in profile limbs of the U-profile.

SUMMARY

In one aspect, an apparatus for connecting a first object to a second object includes a member with a plurality of teeth and an attachment element which includes a plurality of teeth which can engage with the teeth of the member. One of the member and the attachment element are securable to one of the first and second objects. The other of the member and the attachment element are securable to the other of the first and second objects. A securing device prevents the member's teeth from disengaging with the attachment element's teeth such that the attachment element is secured to the member at a certain location along the member. As such, the attachment element can be secured to the member at a plurality of different locations along the member so that the first object can be connected to the second object in a plurality of different positions.

Implementations may include one of the following features, or any combination thereof. The objects are both speakers. The member is curved. The member protrudes through the attachment element. The teeth of the attachment element are located on an internal portion of the element. The securing device is a connection pin that passes through the attachment element. The first object is a speaker. The attachment element is securable to the speaker. The member is securable to the second object. The first object is a speaker and the second object is an array frame.

In another aspect, a method of connecting a first object to a second object includes providing a member with a plurality of teeth and providing an attachment element which includes a plurality of teeth. The teeth of the attachment element are engaged with the teeth of the member. One of the member and the attachment element are securable to one of the first and second objects. The other of the member and the attachment element are securable to the other of the first and second objects. The engaged teeth are secured such that the member's teeth are prevented from disengaging with the attachment element's teeth. As such, the attachment element is secured to the member at a certain location along the member.

Implementations may include one of the above or below features, or any combination thereof. The engaged teeth are unsecured. The attachment element teeth are disengaged from the member teeth. The attachment element teeth are repositioned relative to the member teeth. The attachment element teeth are reengaged with the member teeth. The engaged teeth are re-secured such that the member's teeth are prevented from disengaging with the attachment element's teeth.

In yet another aspect, a speaker which can be connected to another object includes a housing, a member with a plurality of teeth, and an attachment element which includes a plurality of teeth which can engage with the teeth of the member. One of the member and the attachment element are securable to one of the speaker and the object. The other of the member and the attachment element are securable to the other of the speaker and the object. A securing device prevents the member's teeth from disengaging with the attachment element's teeth such that the attachment element is secured to the member at a certain location along the member.

Implementations may include one of the above or below features, or any combination thereof. The securing device is a connection pin that passes through the attachment element.

All examples and features mentioned above can be combined in any technically possible way. Other features and advantages will be apparent from the description and the claims.

DESCRIPTION

The description below discloses an apparatus for connecting a back portion of a line array speaker to another object (e.g. another speaker) as part of a free standing acoustic array or groundstack. The apparatus allows the line array speaker to be placed in a plurality of different positions (e.g. angles) relative to the object. Further speakers can be attached to the top of the line array speaker using integrated connection features to create an array. Up to eight line array speakers can be stacked on top of the object and supported by the connection apparatus. This arrangement allows this speaker array to be "aimed" in the vertical direction to direct the sound field towards a particular designated area for optimal sound quality and coverage.

Figure 1:
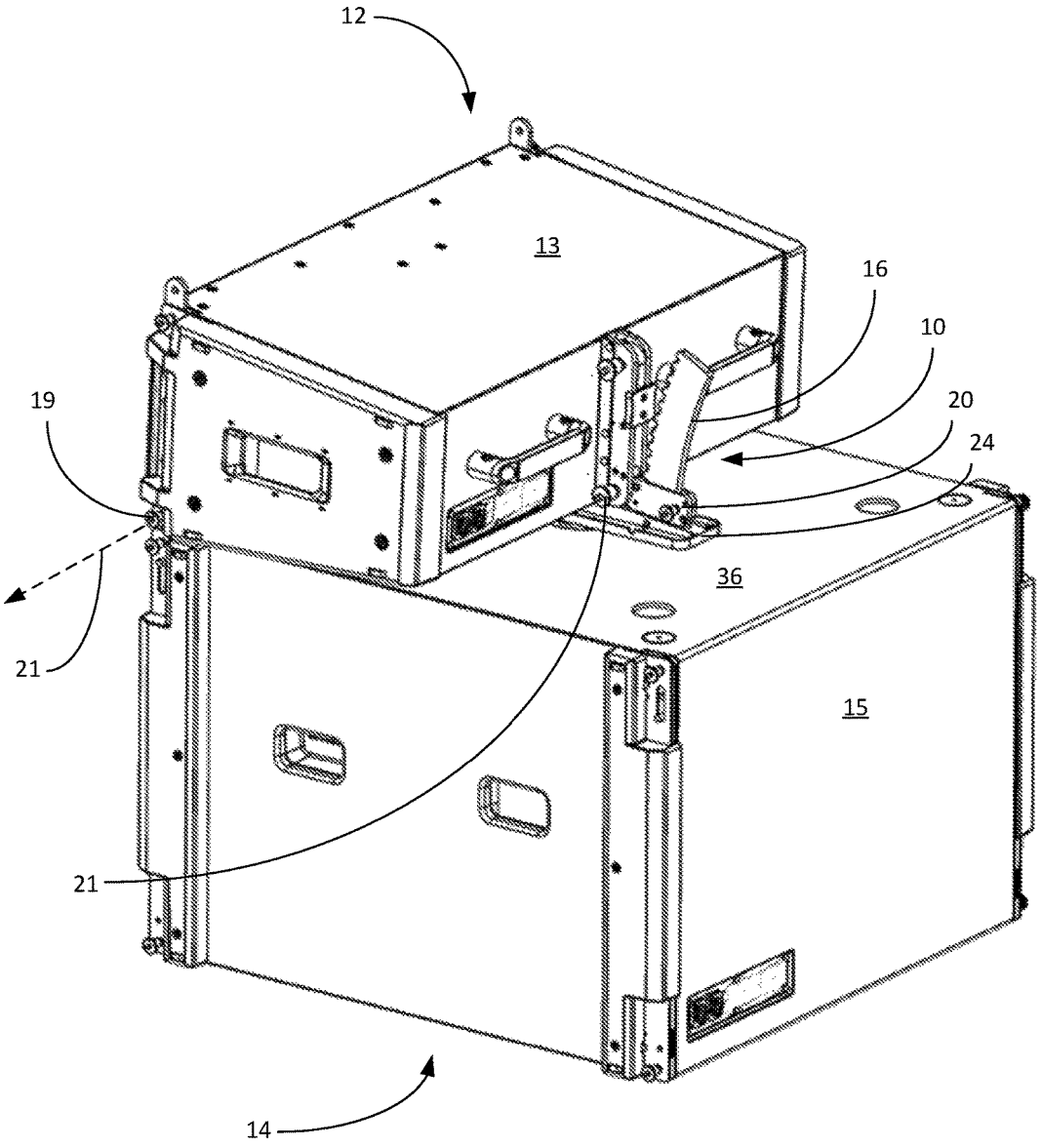
FIG. 1 is a top rear perspective view of a first speaker connected to a second speaker in a first relative position.
Figure 2:
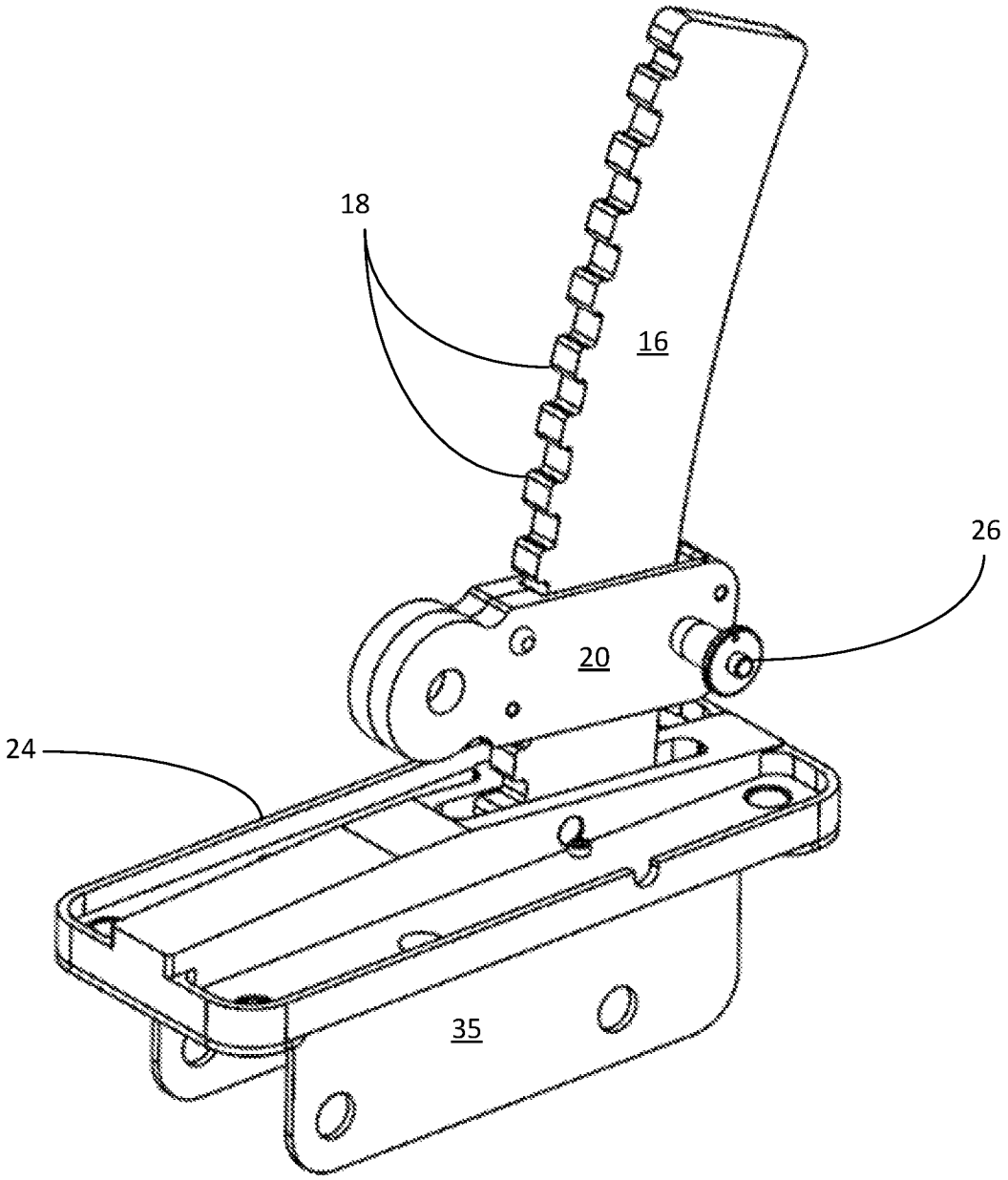
FIG. 2 is a perspective view of a connection apparatus used to connect the speakers of FIG. 1.
Figure 6:
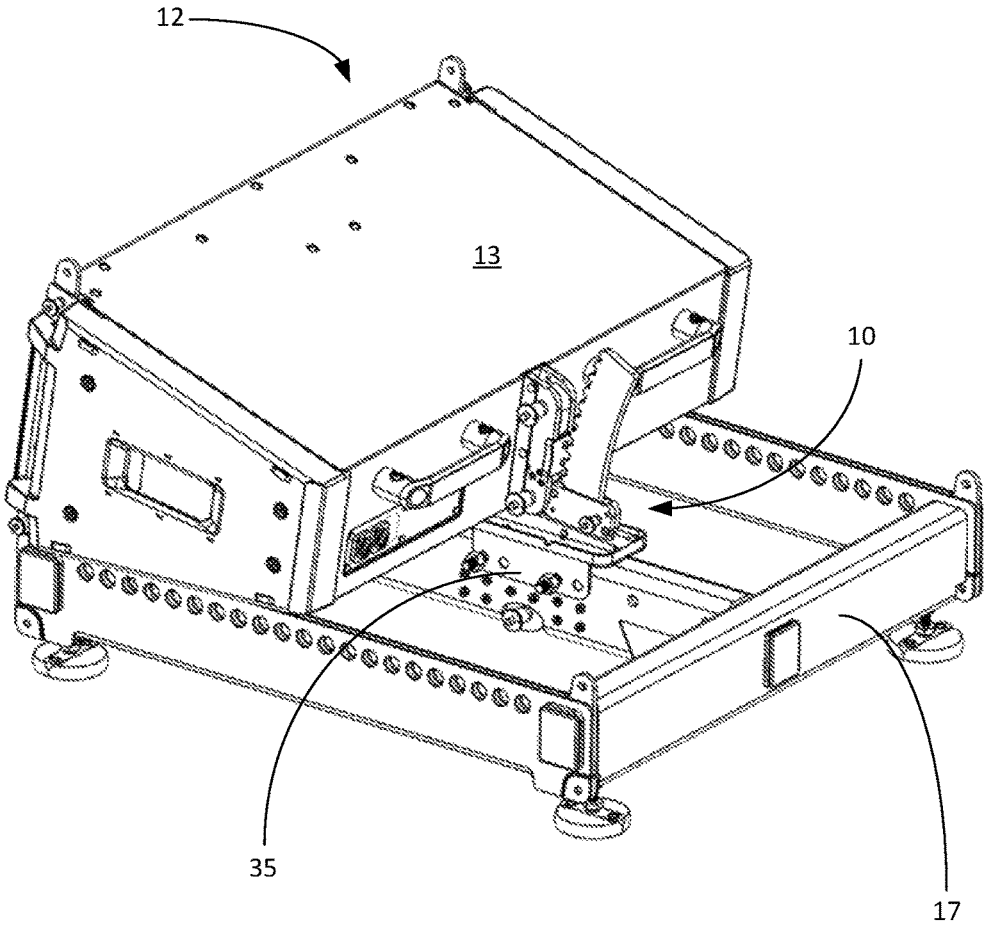
FIG. 6 is a top rear perspective view of a first speaker connected to an array frame in a first relative position.

Referring to FIGS. 1-2, an apparatus 10 for connecting a first object (e.g. a speaker 12 with a housing 13) to a second object (e.g. a speaker 14 with a housing 15, or an array frame 17 as shown in FIG. 6), includes a member 16 with a plurality of teeth 18. In this example the member 16 is curved, but it could have another shape such as straight. A connection pin (e.g. a quick pin) 19 at one end of a front interface of the speakers 12 and 14 and another connection pin (not shown) at the other end of this interface connect the speakers and allow them to rotate about an axis 21 relative to each other.

An attachment element 20 includes a plurality of teeth 22 (see FIGS. 3 and 4) which can engage with the teeth 18 of the member 16. Note that the teeth 22 of the attachment element 20 are located on an internal portion of the attachment element. One of the member 16 and the attachment element 20 is secured to one of the first and second speakers 12 and 14. The other of the member 16 and the attachment element 20 is secured to the other of the first and second speakers 12 and 14. In this example (a) the member 16 is secured to the speaker 14 via a base top portion 24 which is itself secured to the speaker 14, and (b) the attachment element 20 is rotatably secured to the speaker 12 by a connection pin 21.

Figure 3:
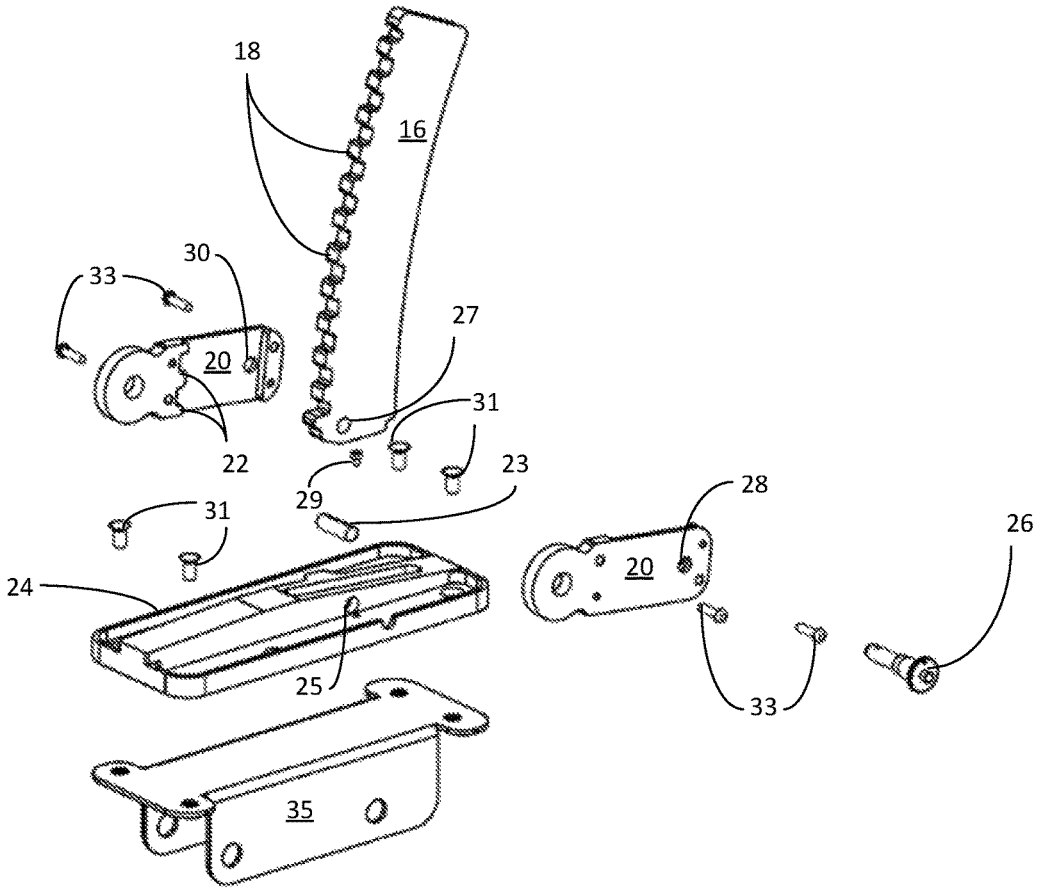
FIG. 3 is an exploded perspective view of the connection apparatus of FIG. 2
Figure 4:
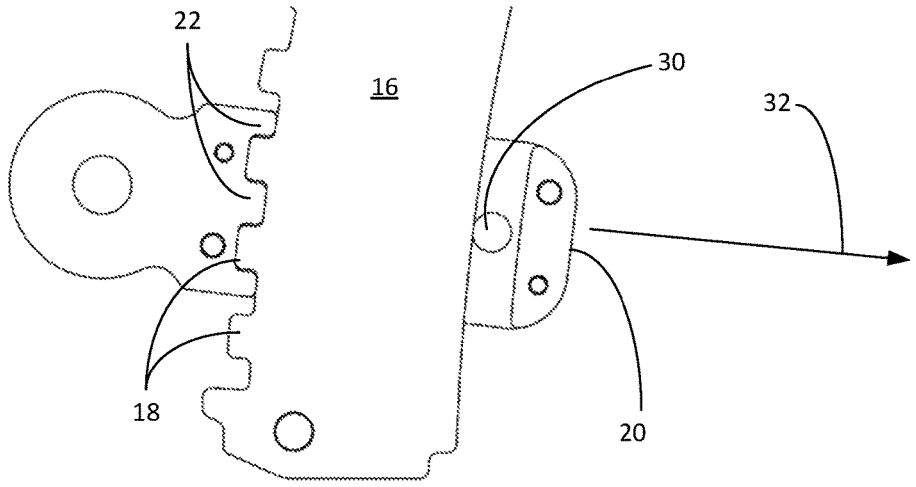
FIG. 4 is a side view of a portion of FIG. 3.

As shown in FIG. 3, a pin 23 passes through a hole 25 in the base top portion 24 and through a hole 27 in the member 16 to rotatably secure the member to the base top portion. A screw 29 is secured into the base top portion 24 to lock the pin 23 into position. Four screws 31 secure the base top portion 24 to the housing 15 of the speaker 14. When the speaker 12 is being connected to an array frame 17 as shown in FIG. 6, the screws 31 secure the base top portion 24 and a base bottom portion 35 together. The base bottom portion 35 is secured to the array frame 17 by a pair of bolts and nuts. Four screws 33 secure two portions of the attachment element 20 together about the member 16. As such, the member 16 protrudes through the attachment element 20. All of the parts shown in FIG. 3 are preferably made of medium or high strength steel Referring to FIGS. 2-4, a securing device in the form of a connection pin 26 prevents the member's teeth 18 from disengaging with the attachment element's teeth 22 such that the attachment element 20 is secured to the member 16 at a certain location along the member. More particularly, when the pin 26 is inserted through holes 28 and 30 to pass through the element 20, the member 16 is prevented from moving in a direction 32 and thus prevents teeth 18 from disengaging with teeth 22 and thereby preventing vertical motion of element 20 in relation to member 18.

To adjust the relative positions of the member 16 and the element 20, the pin 26 is removed from the element 20. Optionally, the pin 21 can be removed to facilitate the position adjustment. The member 16 and element 20 are then rotated about their respective pins 23 and 26 to move the member in the direction 32 and/or the element 20 in a direction opposite to the direction 32 to disengage (i.e. unsecure) teeth 18 from teeth 22. The member 16 and/or the element 20 are then moved to cause the member to move in a direction perpendicular to the direction 32 (in the plane of FIG. 3) relative to the element 20. This repositions the teeth 22 relative to the teeth 18. The member 16 and element 20 are again rotated about their respective pins 23 and 26 to move the member in a direction opposite to the direction 32 to reengage teeth 18 with teeth 22. Finally, the pin 26 is reinserted through holes 28 and 30 to secure the teeth 18 and the teeth 22 together such that the teeth 18 are prevented from disengaging with the teeth 22. As such, the attachment element 20 can be secured to the member 16 at a plurality of different locations along the member 16 so that the speaker 12 can be connected to the speaker 14 in a plurality of different positions (e.g. in a plurality of different relative angles).

Figure 5:
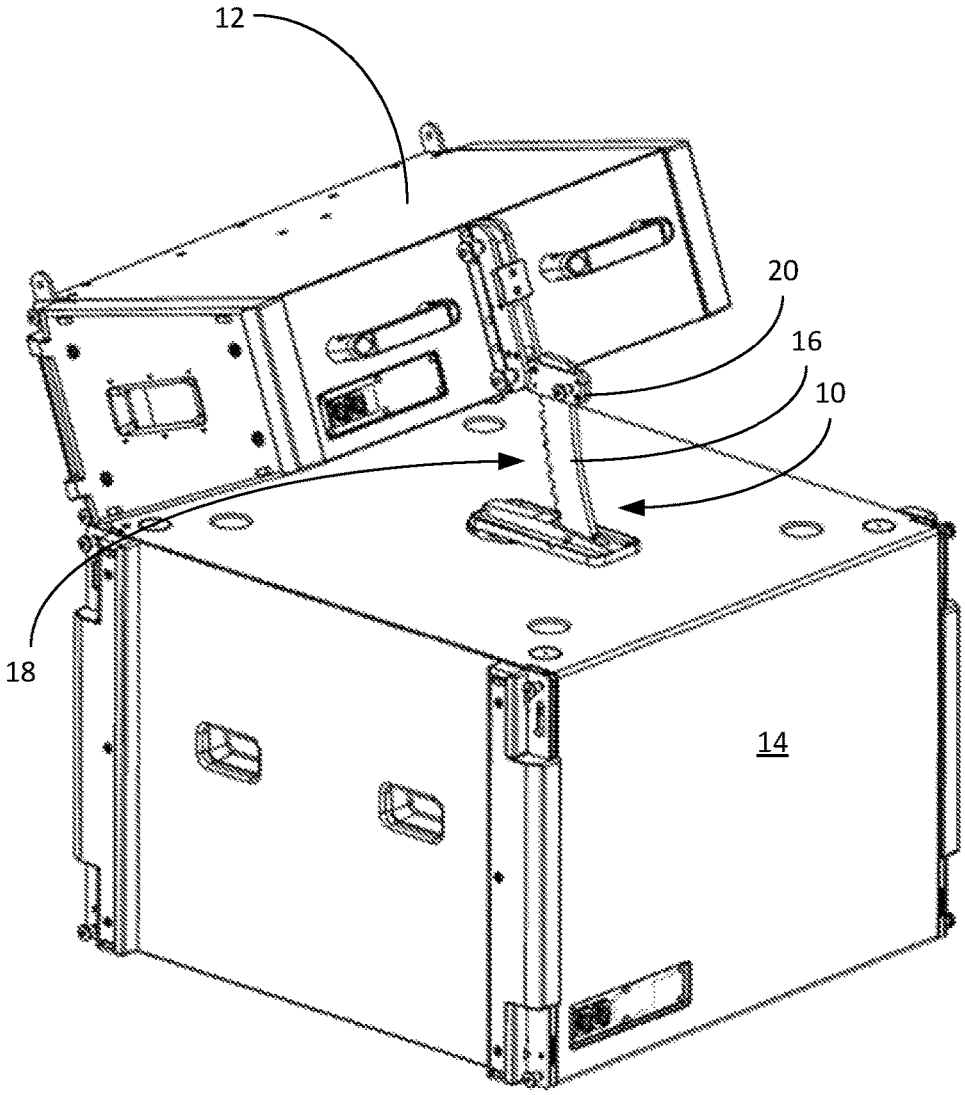
FIG. 5 is a top rear perspective view of the first speaker connected to the second speaker in a second relative position.

In FIG. 1 the attachment element 20 is shown secured to the member 16 in a lowermost position. This causes the bottom face (not visible) of the speaker 12 and a top face 36 of the speaker 14 to be at an angle of about 2.5 degrees from each other. In FIG. 5 the attachment element 20 is shown secured to the member 16 in an uppermost position. This causes the bottom face of the speaker 12 and the top face 36 of the speaker 14 to be at an angle of about 25 degrees from each other. This angle can also be set to a number of different degrees in 2.5 degree increments between 2.5 and 25 degrees. This arrangement allows a single pin to be removed, the speakers 12 and 14 to be set at a desired angle to each other, and the pin to be reinserted to secure the connection apparatus. As such, a very simple and low cost connection apparatus allows quick position adjustments of speakers while being safe and easy to use.

A number of implementations have been described. Nevertheless, it will be understood that additional modifications may be made without departing from the scope of the inventive concepts described herein, and, accordingly, other embodiments are within the scope of the following claims. For example, although the above description is written in terms of a free standing acoustic array or groundstack, the connecting apparatus can be used when the speaker 12 and speaker 14 (or array frame 17) are suspended in the air (i.e. "flown"). In this case six screws 31 would be used to secure the base top portion 24 to the speaker 14 as the apparatus would now be in tension instead of compression as was the case in the previous examples discussed.

What is claimed is:

1. An apparatus for connecting a first object to a second object, comprising:

a member with a plurality of teeth;

an attachment element which includes a plurality of teeth which can engage with the teeth of the member, one of the member and the attachment element being securable to one of the first and second objects, the other of the member and the attachment element being securable to the other of the first and second objects; and a securing device which prevents the member's teeth from disengaging with the attachment element's teeth such that the attachment element is secured to the member at a certain location along the member, whereby the attachment element can be secured to the member at a plurality of different locations along the member so that the first object can be connected to the second object in a plurality of different positions wherein the member protrudes through the attachment element; wherein at least one of the object is a speaker.

2. The apparatus of claim 1, wherein the objects are both speakers.

3. The apparatus of claim 1, wherein the member is curved.

4. The apparatus of claim 1, wherein the teeth of the attachment element are located on an internal portion of the element.

5. The apparatus of claim 1, wherein the securing device is a connection pin that passes through the attachment element.

6. The apparatus of claim 1, wherein the first object is a speaker, the attachment element is securable to the speaker, and the member is securable to the second object.

7. The apparatus of claim 1, wherein the first object is a speaker and the second object is an array frame.

8. A method of connecting a first object to a second object, comprising:

providing a member with a plurality of teeth;

providing an attachment element which includes a plurality of teeth;

engaging the teeth of the attachment element with the teeth of the member, one of the member and the attachment element being securable to one of the first and second objects, the other of the member and the attachment element being securable to the other of the first and second objects; and securing the engaged teeth such that the member's teeth are prevented from disengaging with the attachment element's teeth such that the attachment element is secured to the member at a certain location along the member wherein the teeth of the attachment element are located on an internal portion of the element; wherein at least one of the object is a speaker.

9. The method of claim 8, further comprising:

unsecuring the engaged teeth;

disengaging the attachment element teeth from the member teeth;

repositioning the attachment element teeth relative to the member teeth;

reengaging the attachment element teeth with the member teeth; and resecuring the engaged teeth such that the member's teeth are prevented from disengaging with the attachment element's teeth, whereby the attachment element can be secured to the member at a plurality of different locations along the member so that the first object can be connected to the second object in a plurality of different positions.

10. The method of claim 8, wherein the objects are both speakers.

11. The method of claim 8, wherein the member is curved.

12. The method of claim 8, wherein the member protrudes through the attachment element.

13. The method of claim 8, wherein the securing step is accomplished with a connection pin that passes through the attachment element.

14. The method of claim 8, wherein the first object is a speaker, the attachment element is securable to the speaker, and the member is securable to the second object.

15. A speaker which can be connected to another object, comprising:

a housing;

a member with a plurality of teeth;

an attachment element which includes a plurality of teeth which can engage with the teeth of the member, one of the member and the attachment element being securable to one of the speaker and the object, the other of the member and the attachment element being securable to the other of the speaker and the object; and a securing device which prevents the member's teeth from disengaging with the attachment element's teeth such that the attachment element is secured to the member at a certain location along the member, whereby the attachment element can be secured to the member at a plurality of different locations along the member so that the speaker can be connected to the second object in a plurality of different positions wherein the teeth of the attachment element are located on an internal portion of the element; wherein at least one of the object is a speaker.

16. The apparatus of claim 15, wherein the member is curved.

17. The apparatus of claim 15, wherein the member protrudes through the attachment element.

18. The apparatus of claim 15, wherein the securing device is a connection pin that passes through the attachment element.

* * * * *